US011485549B2

(12) United States Patent
Fujishige et al.

(10) Patent No.: US 11,485,549 B2
(45) Date of Patent: Nov. 1, 2022

(54) CAP CONFIGURED TO RETAIN SEALING MEMBER IN CAP BODY

(71) Applicant: Daiwa Can Company, Tokyo (JP)

(72) Inventors: Eiji Fujishige, Sagamihara (JP); Junji Matsumura, Sagamihara (JP); Eiji Araki, Sagamihara (JP); Kenji Takagi, Sagamihara (JP); Takashi Kawada, Sagamihara (JP)

(73) Assignee: DAIWA CAN COMPANY, Tokyo (JP)

( * ) Notice: Subject to any disclaimer, the term of this patent is extended or adjusted under 35 U.S.C. 154(b) by 0 days.

(21) Appl. No.: 17/158,721

(22) Filed: Jan. 26, 2021

(65) Prior Publication Data

US 2021/0147121 A1 May 20, 2021

Related U.S. Application Data

(63) Continuation of application No. PCT/JP2019/028763, filed on Jul. 23, 2019.

(30) Foreign Application Priority Data

Jul. 27, 2018 (JP) ..... JP2018-141637

(51) Int. Cl.
*B65D 41/34* (2006.01)

(52) U.S. Cl.
CPC ..... *B65D 41/3428* (2013.01)

(58) Field of Classification Search
CPC ..... B65D 41/3428; B65D 41/348; B65D 41/325; B65D 51/1688; B65D 7/02
(Continued)

(56) References Cited

U.S. PATENT DOCUMENTS 3,713,545 A * 1/1973 Lawrence ..... B65D 51/1661 215/260
3,749,272 A * 7/1973 Brockett ..... B65D 53/04 215/341

(Continued)

FOREIGN PATENT DOCUMENTS

CN 102892684 A 1/2013
CN 106470915 A 3/2017

(Continued)

OTHER PUBLICATIONS

International Search Report dated Sep. 10, 2019 in connection with PCT International Application No. PCT/JP2019/028763.

(Continued)

*Primary Examiner* — Chun Hoi Cheung
*Assistant Examiner* — Brijesh V. Patel
(74) *Attorney, Agent, or Firm* — John P. White

(57) ABSTRACT

A cap includes a cap body including a top plate portion and a skirt portion; a sealing member that is a separate member from the cap body and is provided in the cap body, the sealing member having an outer diameter smaller than an inner diameter of the skirt portion; a plurality of locking portions provided in a circumferential direction of the skirt portion, and configured to regulate a movement of the sealing member in a direction away from the top plate portion and support the sealing member; and a plurality of regulating portions provided in the circumferential direction of the skirt portion, protruding inward in a radial direction than an inner peripheral surface of the skirt portion, and configured to regulate a radial movement of the sealing member.

4 Claims, 4 Drawing Sheets

(58) Field of Classification Search
USPC ..... 220/303, 316, 367.1, 360, 310.1, 289, 220/231, 366, 367; 215/307, 323, 337, 215/347, 349–350, 327, 260–261, 311, 215/314, 252
See application file for complete search history.

(56) References Cited

U.S. PATENT DOCUMENTS

| | | | | | |
|---|---|---|---|---|---|
| 3,861,551 | A * | 1/1975 | Hannon | B21D 51/50 | 215/252 |
| 3,966,071 | A * | 6/1976 | Northup | B65D 41/348 | 215/260 |
| 4,007,848 | A * | 2/1977 | Snyder | B65D 41/348 | 215/44 |
| 4,007,851 | A * | 2/1977 | Walker | B65D 41/348 | 215/307 |
| RE31,546 | E * | 4/1984 | Walker | B65D 41/348 | 215/307 |
| 4,611,723 | A * | 9/1986 | Megowen | B65D 41/348 | 215/252 |
| 7,147,123 | B2 * | 12/2006 | Yamashita | B65D 41/045 | 220/366.1 |
| 7,581,651 | B2 * | 9/2009 | Matukawa | B65D 41/3428 | 215/252 |
| 7,611,026 | B1 * | 11/2009 | Bloom | B65D 41/045 | 215/252 |
| 8,167,161 | B2 * | 5/2012 | Ichimura | B65D 41/045 | 220/303 |
| 8,640,898 | B2 * | 2/2014 | ParrinelIo | B65D 41/045 | 215/341 |
| 8,689,990 | B2 * | 4/2014 | Hdeyasu | B65D 53/04 | 215/350 |
| 8,833,590 | B2 * | 9/2014 | Ichimura | B65D 41/348 | 220/303 |
| 2003/0098286 | A1 * | 5/2003 | Bloom | B65D 41/045 | 215/349 |
| 2008/0073309 | A1 * | 3/2008 | Nakajima | B65D 41/348 | 215/252 |
| 2010/0065528 | A1 * | 3/2010 | Hanafusa | B65D 41/045 | 220/303 |
| 2016/0052678 | A1 * | 2/2016 | Hanafusa | B65D 41/045 | 215/347 |
| 2017/0137188 | A1 * | 5/2017 | Tsuchiya | B29C 43/146 | |

FOREIGN PATENT DOCUMENTS

| | | | |
|---|---|---|---|
| CN | 107161514 | A | 9/2017 |
| JP | 2009-073495 | A | 4/2009 |
| JP | 2013-082463 | A | 5/2013 |
| JP | 2013082463 | A * | 5/2013 |
| JP | 2014-051326 | A | 3/2014 |
| JP | 2015-081116 | A | 4/2015 |
| JP | 2016-011138 | A | 1/2016 |
| JP | 2016-026961 | A | 2/2016 |
| JP | 2017-178421 | A | 10/2017 |
| WO | WO 2020/022306 | A1 | 1/2020 |

OTHER PUBLICATIONS

PCT International Patent Application Publication No. WO 2020/022306 A1, published Jan. 30, 2020 to Daiwa Can Company, including English language translation of abstract (Exhibit 1).
Japanese Patent Application Publication No. JP 2017-78421 A, published Oct. 5, 2017 to Daiwa Can Co Ltd, including English language translation of abstract (Exhibit 2).
Japanese Patent Application Publication No. JP 2016-026961 A, published Feb. 18, 2016 to Nippon Closures Co., Ltd., including English language translation of abstract (Exhibit 3).
Japanese Patent Application Publication No. JP 2016-011138 A, published Jan. 21, 2016 to Universal Can Corporation, including English language translation of abstract (Exhibit 4).
Japanese Patent Application Publication No. JP 2015-081116 A, published Apr. 27, 2015 to Universal Can Corporation, including English language translation of abstract (Exhibit 5).
Japanese Patent Application Publication No. JP 2014-051326 A, published Mar. 20, 2014 to Universal Can Corporation, including English language translation of abstract (Exhibit 6).
Japanese Patent Application Publication No. JP 2013-082463 A, published May 9, 2013 to Japan Crown Cork Co., Ltd., including English language translation of abstract (Exhibit 7).
International Search Report dated Sep. 10, 2019 in connection with PCT International Application No. PCT/JP2019/028763, including English language translation (Exhibit 8).
International Preliminary Report on Patentability dated Feb. 2, 2021, including Cover Sheet and English translation of the Written Opinion of the International Searching Authority dated Sep. 10, 2019 in connection with PCT International Application No. PCT/JP2019/028763, as well as Japanese language version of the Written Opinion as issued.
Japanese official action dated Apr. 12, 2022 (and English translation thereof) in corresponding Japanese Patent Application No. 2018-141637.
Chinese official action dated Jun. 1, 2022 (and English translation thereof) in corresponding Chinese Patent Application No. 2019800473449.

* cited by examiner

CAP CONFIGURED TO RETAIN SEALING MEMBER IN CAP BODY

CROSS-REFERENCE TO RELATED APPLICATIONS

This is a Continuation Application of PCT application No. PCT/JP2019/028763, filed Jul. 23, 2019, which was published under PCT Article 21(2) in Japanese.

This application is based upon and claims the benefit of priority from Japanese Patent Application No. 2018-141637, filed Jul. 27, 2018, the entire contents of which are incorporated herein by reference.

BACKGROUND

Field

The present invention relates to a cap for closing a can container.

Description of the Related Art

Conventionally, a cap that seals a mouth portion of a can container is configured so that a sealing member made of a resin material that is in close contact with the mouth portion is provided on an inner surface of a cap body. For such a cap, Jpn. Pat. Appln. KOKAI Publication No. 2017-178421 discloses a technique in which a cap body and a sealing member are not bonded to each other so as to reduce the opening torque at the time of opening a cap. When the sealing member is not bonded as described above, a locking protrusion protruding inward on a skirt portion of the cap body is formed, thereby locking the sealing member to prevent the sealing member from falling off.

Such a sealing member is manufactured by, for example, supplying a molten or softened resin material into the cap body and molding the resin material into a predetermined shape with a mold.

SUMMARY

However, the sealing member described above may shrink after being molded into a predetermined shape, and the outer diameter of the sealing member may become smaller than the inner diameter of the cap body. Since the sealing member not bonded to the cap body can move in a radial direction within the cap body, the sealing member may move in a radial direction with respect to the cap body, preventing the sealing portion that comes into close contact with the mouth portion of the container from favorably contacting the mouth portion, resulting in degradation of the sealing performance.

It is therefore an object of the present invention to provide a cap capable of securing the sealing performance of a sealing member not bonded to a cap body.

According to one aspect of the present invention, a cap includes a cap body including a disk-shaped top plate portion and a tubular skirt portion provided on a peripheral edge of the top plate portion; a sealing member that is a separate member from the cap body and is provided in the cap body so as to face the top plate portion, the sealing member having an outer diameter smaller than an inner diameter of the skirt portion; a plurality of locking portions provided in a circumferential direction of the skirt portion, and configured to regulate a movement of the sealing member in a direction away from the top plate portion and support the sealing member; and a plurality of regulating portions provided in the circumferential direction of the skirt portion, protruding inward in a radial direction than an inner peripheral surface of the skirt portion, and configured to regulate a radial movement of the sealing member.

DETAILED DESCRIPTION

Hereinafter, a cap 1 according to an embodiment of the present invention will be described with reference to FIGS. 1 to 6.

Figure 1:
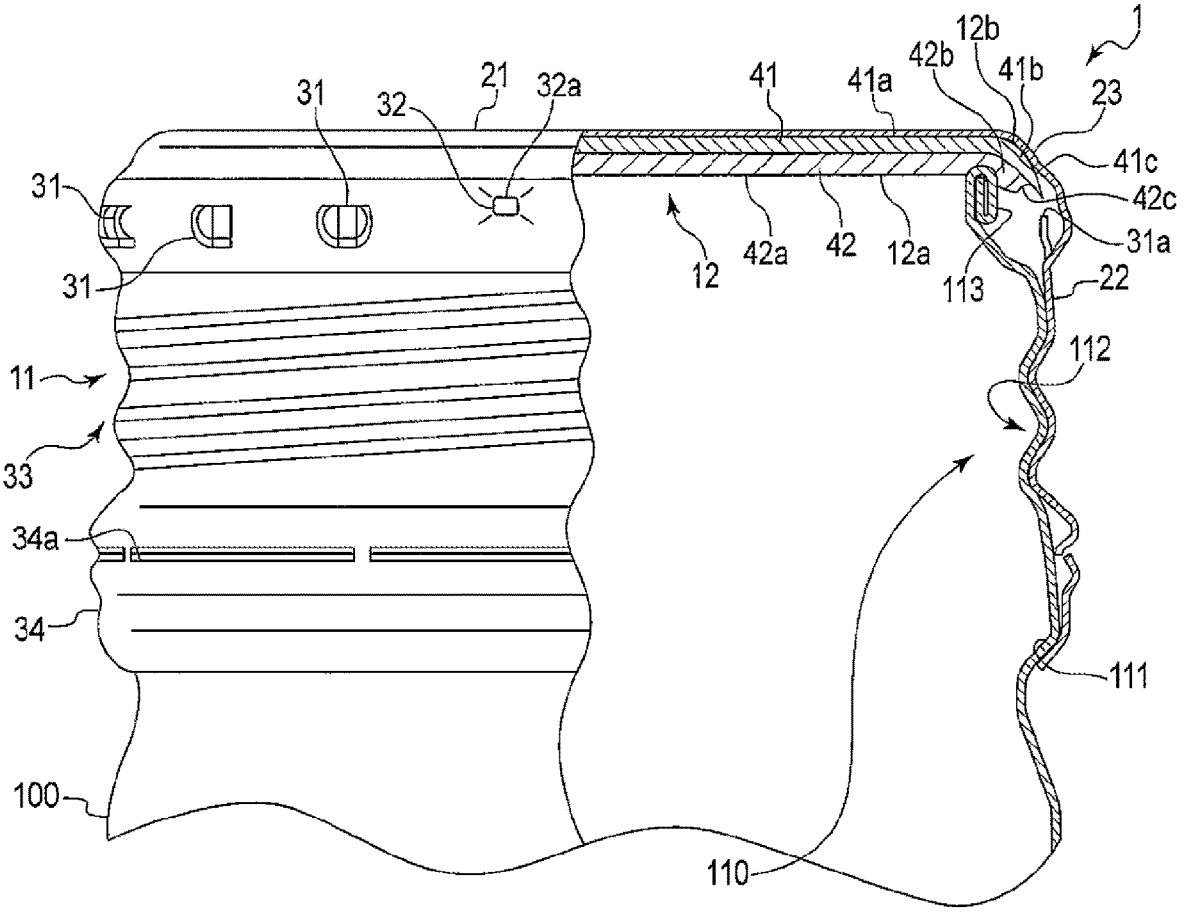
FIG. 1 is a partial cross-sectional side view of a configuration of a cap according to a first embodiment of the present invention.
Figure 2:
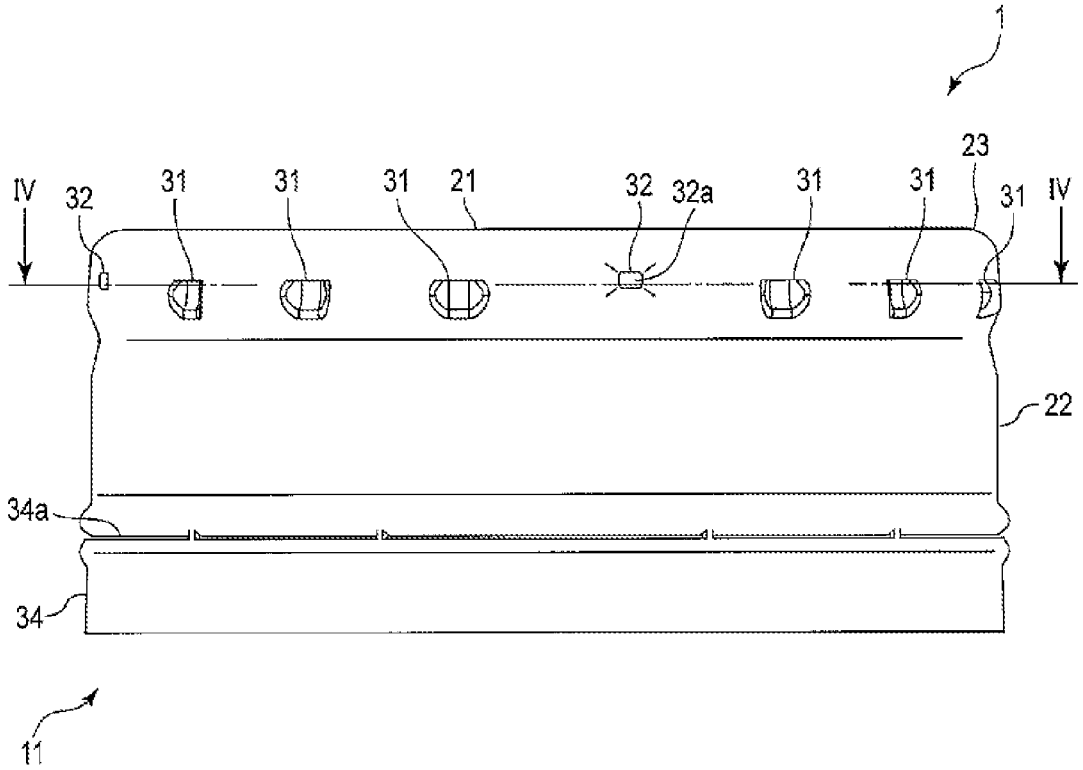
FIG. 2 is a side view of the configuration of the cap.
Figure 3:
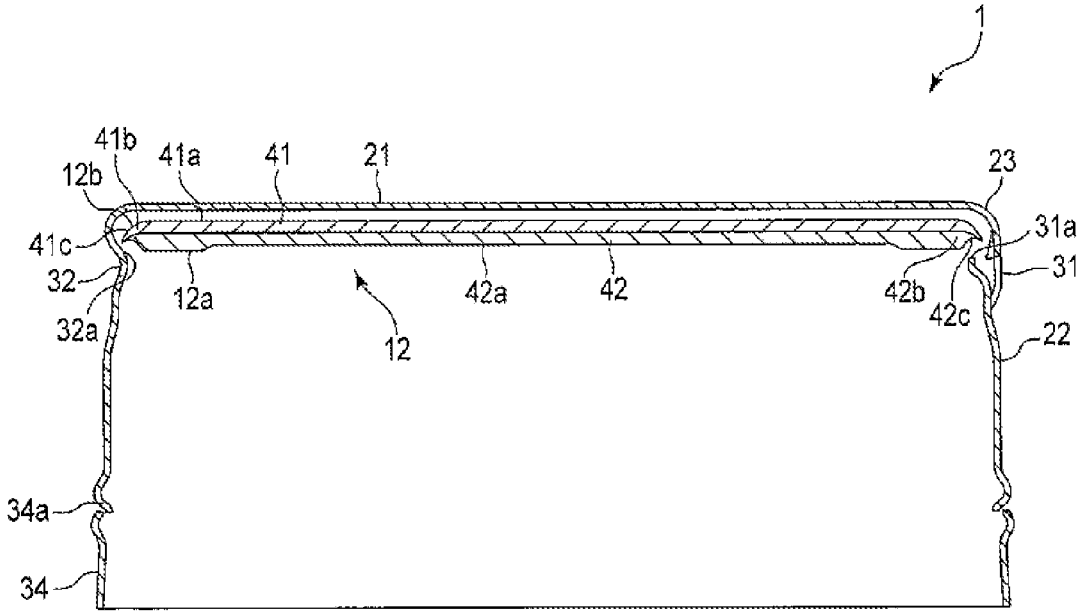
FIG. 3 is a cross-sectional view of the configuration of the cap.
Figure 4:
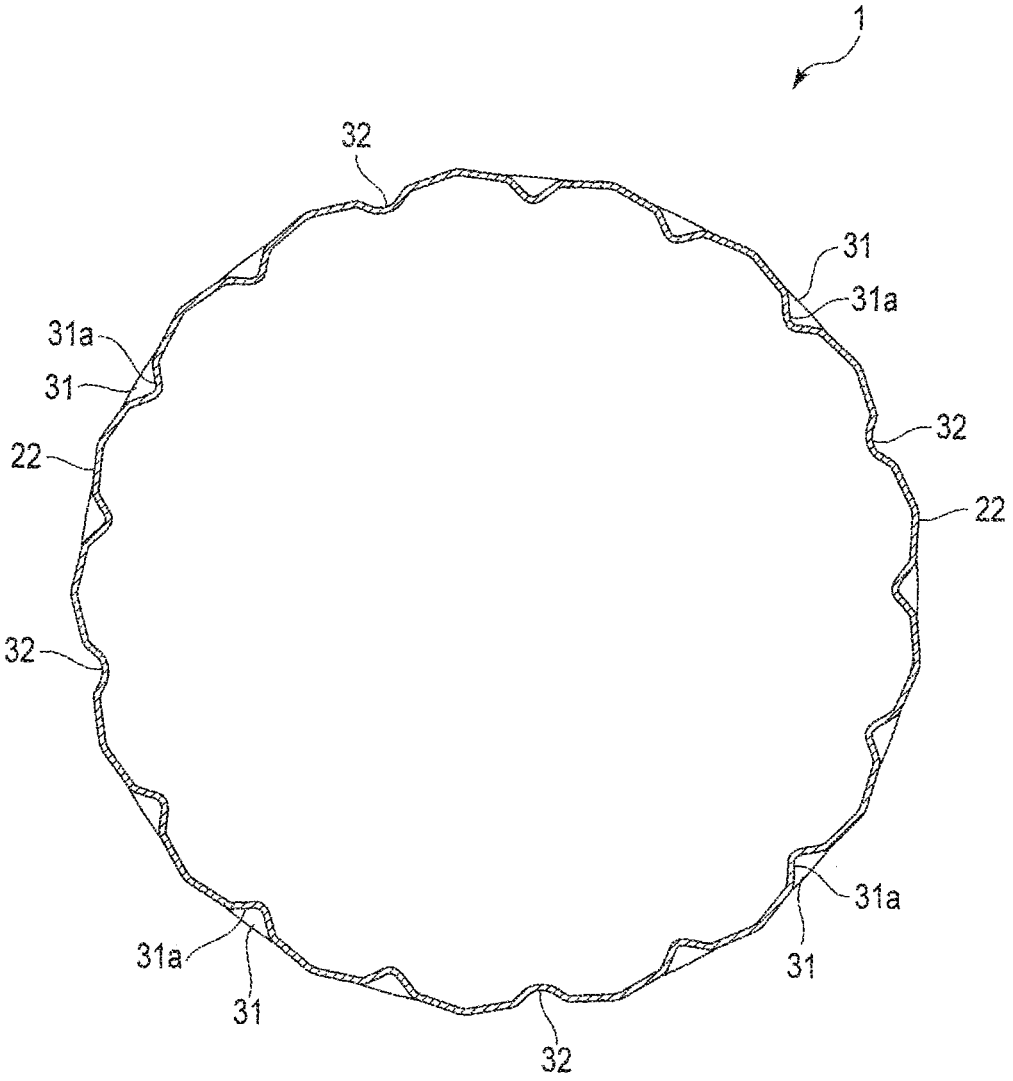
FIG. 4 is a cross-sectional view of the configuration of the cap.
Figure 5:
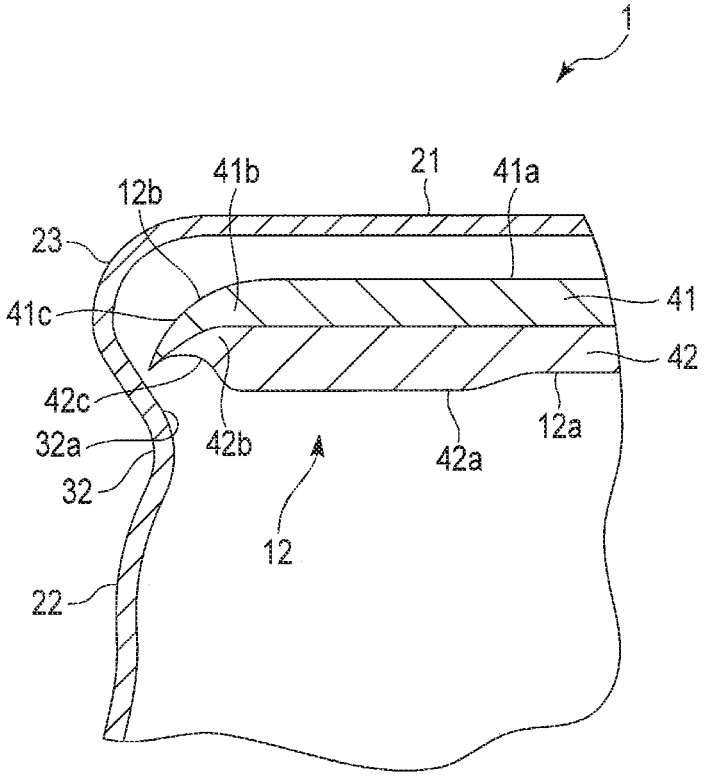
FIG. 5 is a cross-sectional view of the configuration of the main parts of the cap.
Figure 6:
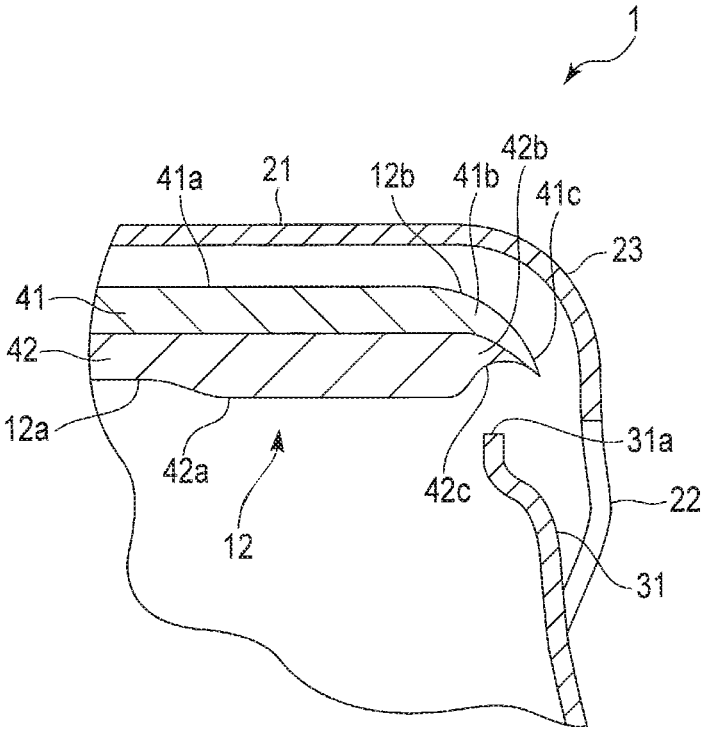
FIG. 6 is a cross-sectional view of the configuration of the main parts of the cap.

FIG. 1 is a partial cross-sectional side view of a configuration of the cap 1 according to a first embodiment of the present invention. FIG. 2 is a side view of the configuration of the cap 1. FIG. 3 is a cross-sectional view of the configuration of the cap 1. FIG. 4 is a cross-sectional view of the configuration of the cap 1 taken along line IV-IV. FIGS. 5 and 6 are schematic cross-sectional views of the configuration of the main parts of the cap 1.

As shown in FIG. 1, the cap 1 is attached to a mouth portion 110 of a can container 100, and is wound and fastened in a state of covering the mouth portion 110 of the can container 100, thereby sealing the can container 100.

Here, the can container 100 a so-called bottle-shaped container that contains a beverage or the like. For example, the can container 100 is made of a metal material such as an aluminum alloy or a surface-treated steel plate where a resin film is layered on both surfaces. The can container 100 is formed in a cylindrical shape having different outer diameters with one end reduced in diameter. The can container 100 includes, at one end thereof, the mouth portion 110 that discharges the beverage contained in the can container 100. The mouth portion 110 includes a jaw portion 111, a male screw portion 112, and a curl portion 113 on an outer peripheral surface thereof from a bottom surface side toward an end of the can container 100.

The jaw portion 111 is configured by protruding annularly. The curl portion 113 is formed to have a diameter smaller than that of the male screw portion 112. The curl portion 113 is configured to have a diameter smaller than the inner diameter of the cap 1. The curl portion 113 is configured by folding an end of the mouth portion 110 one or more times. The curl portion 113 forms an opening through which the beverage stored in the can container 100 is discharged.

As shown in FIGS. 1 and 3, the cap 1 includes a cap body 11 and a sealing member 12 provided separately in the cap body 11.

The cap body 11 is made of a material obtained by forming resin film layer on a metal material such as an aluminum alloy. The cap body 11 is formed by performing each molding such as drawing said material having a thin flat-plate shape into a cup shape, knurling molding, and roll-on molding.

The cap body 11 includes a disk-shaped top plate portion 21 and a cylindrical skirt portion 22 integrally provided on a peripheral edge of the top plate portion 21. The cap body 11 is configured such that the top plate portion 21 and the skirt portion 22 are integrally and continuously formed by an annular and curved corner portion 23.

The top plate portion 21 is formed in a disk shape, and a main surface thereof is formed in a flat surface. One end of the skirt portion 22 is continuous with the top plate portion 21 via the corner portion 23, and the other end of the portion is open. As shown in FIGS. 1 to 6, the skirt portion 22 includes a plurality of knurl portions 31 each having a vent slit 31*a*, a plurality of recessed portions 32, a female screw portion 33, and a tamper evidence band portion 34, from the end on the top plate portion 21 side to the open end.

As shown in FIGS. 1 to 6, the plurality of knurl portions 31, the plurality of recessed portions 32, the female screw portion 33, and the tamper evidence band portion 34 are formed by performing knurling molding, roll-on molding, or the like on a cup-shaped molded article formed of the top plate portion 21, the cylindrical skirt portion 22, were the plurality of knurl portions 31, the plurality of recessed portions 32, the female screw portion 33, and the tamper evidence band portion 34 are not formed, and the corner portion 23.

The knurl portion 31 includes the vent slit 31*a* and protrudes from the inner peripheral surface of the skirt portion 22. In other words, the knurl portion 31 forms a partially cut protrusion on the inner peripheral surface of the skirt portion 22 by depressing a part of the skirt portion 22 inward in the radial direction of the skirt portion 22.

The plurality of knurl portions 31 are provided in the circumferential direction of the skirt portion 22. The vent slit 31*a* is a slit through which gas or the like in the can container 100 is discharged at the time of opening. The vent slit 31*a* is formed by cutting the end of the knurl portion 31 on the top plate portion 21 side.

The diameter of a tangent circle that is continuous with radially innermost ends of the ends of the above-described plurality of knurl portions 31 on the vent slit 31*a* side, in other words, the ends of the plurality of knurl portions 31 on the top plate portion 21 side, is set to be smaller than the outer diameter of the sealing member 12. Therefore, the plurality of knurl portions 31 form a locking portion that regulates the movement of the sealing member 12 arranged on the top plate portion 21 in a direction away from the top plate portion 21.

The recessed portion 32 is formed by depressing a part of the skirt portion 22 from the outer peripheral surface side toward the inner peripheral surface side. Specifically, the recessed portion 32 forms a protrusion on the inner peripheral surface of the skirt portion 22 by depressing a part of the skirt portion 22 inward in the radial direction of the skirt portion 22.

The recessed portion 32 includes an inclined surface 32*a* on the inner side of the skirt portion 22. The inclined surface 32*a* is inclined in a direction away from the top plate portion 21 in the axial direction and toward the inner side in the radial direction. In other words, with the increase in the height of the recessed portion 32 from the inner peripheral surface of the skirt portion 22 as the recessed portion 32 moves away from the top plate portion 21, the inner surface of the recessed portion 32 is inclined.

A plurality of recessed portions 32 are provided, preferably three or more, and in the present embodiment, four. For example, the recessed portions 32 are arranged at substantially equal intervals along the circumferential direction of the skirt portion 22. The diameter of a tangent circle that is continuous with the inclined surfaces 32*a* of the plurality of recessed portions 32 is the same as the outer diameter of the sealing member 12 at least in part in the axial direction. In other words, the plurality of inclined surfaces 32*a* are regulating portions that are configured to be able to contact the outer peripheral edge of the sealing member 12 in part in the axial direction, regulate the radial movement of the contacted sealing member 12, and position the sealing member 12 in the radial direction. That is, the plurality of recessed portions 32 perform centering of the sealing member 12 in contact with the inclined surfaces 32*a* with respect to the cap body 11. Also, the diameter of a tangent circle that is continuous with the lowermost ends of the plurality of inclined surfaces 32*a* in the axial direction is set to be larger than the diameter of a tangent circle that is continuous with the radially innermost ends of the ends of the plurality of knurl portions 31 on the vent slit 31*a* side.

At least a portion of the plurality of recessed portions 32 having the same diameter as the outer diameter of the sealing member 12 on the inclined surfaces 32*a* is arranged closer to the top plate portion 21 in the axial direction of the skirt portion 22 than the locking portion that is an end of the knurl portion 31 on the vent slit 31*a* side. For example, the plurality of recessed portions are arranged together with the plurality knurl portions 31 in the circumferential direction of the skirt portion 22, and are arranged closer to the top plate portion 21 in the axial direction of the skirt portion 22 than the plurality of knurl portions 31.

In the present embodiment, the plurality of knurl portions provided at thirteen areas, and the plurality of recessed portions 32 are provided at four areas, as shown in FIG. 4. For example, in the circumferential direction of the skirt portion 22, three knurl portions 31 are arranged at three areas; and four knurl portions 31 are arranged at one location, with one recessed portion 32 arranged between the rows of the knurl portions 31. Further, the present embodiment, the plurality of recessed portions 32 are arranged closer to the top plate portion 21 than the plurality of knurl portions 31 of the skirt portion 22.

The female screw portion 33 is configured to be screwable with the male screw portion 112 of the can container 100. The female screw portion 33 is formed together with the can container 100. That is, the female screw portion 33 is not formed in the cap 1 before being attached to the can container 100, but formed when it is integrally combined with the can container 100.

The tamper evidence band portion 34 engages with the jaw portion 111 of the can container 100 in the direction in which the cap 1 is separated from the can container 100 and in the axial direction of the cap 1. Also, the tamper evidence band portion 34 includes a break portion 34*a* for breaking when the cap 1 is opened and detaching from the skirt portion 22. That is, the tamper evidence band portion 34 is configured by forming a slit while leaving the break portion 34*a* on the end side of the skirt portion 22, and engages with the jaw portion 111 by being formed into the shape of the jaw portion 111 of the can container 100 when the tamper evidence band portion 34 is integrally combined with the can container 100 in a manner similar to the female screw portion 33.

The sealing member 12 is formed separately from the cap body 11. That is, the sealing member 12 is arranged so as to face the top plate portion 21 and the skirt portion 22, and is not bonded to the cap 1. Specifically, the sealing member 12 is formed in a disk shape and has an outer diameter larger than the diameter of an inscribed circle of the knurl portion 31 provided on the skirt portion 22 of the cap body 11. Also, the sealing member 12 has the same outer diameter as the diameter of an inscribed circle of at least a part of the inclined surface 32*a* the recessed portion 32 protruding in the radial direction from the inner peripheral surface of the skirt portion 22, specifically the central portion in the axial direction of the inclined surface 32*a*.

The sealing member 12 is engaged, in the axial direction of the cap body 11, with the end of the knurl portion 31 protruding in a radial direction from the inner peripheral surface of the skirt portion 22 where the vent slit 31*a* is provided, and thereby the sealing member 12 is inhibited from falling off from the cap body 11. Thus, although the sealing member 12 is not bonded to the cap body 11, the sealing member 12 is integrally provided with the cap body 11. Also, the sealing member 12 is centered on the axis of the cap body 11 by engaging, in the radial direction of the cap body 11, with the inclined surface 32*a* of the recessed portion 32 protruding in the radial direction from the inner peripheral surface of the skirt portion 22.

The sealing member 12 includes a disc-shaped sliding layer 41 and a disc-shaped sealing layer 42 integrally stacked on the sliding layer 41. The sealing member 12 is formed by integrally molding the sliding layer 41 and the sealing layer 42 with different resin materials. The sealing member 12 includes a flat plate portion 12*a* having a uniform thickness and a curved surface portion 12*b* whose outer surface of the outer peripheral edge on the top plate portion 21 side is formed of a curved surface. In other words, the sealing member 12 is formed in a disk shape, and the ridge portion on the top plate portion 21 side is formed of a curved surface having a predetermined curvature. Also, in the sealing member 12, the curved surface portion 12*b* constituting the outer peripheral edge side is formed to be thinner than the flat plate portion 12*a*, the curved surface portion 12*b* is gradually reduced in thickness from the central side toward the outer peripheral edge, and the tip of the curved surface portion 12*b*, that is, the outer peripheral edge, is formed to be the thinnest among the other portions. The flat plate portion 12*a* constitutes a sealed portion where a part of the flat plate portion 12*a* on the curved surface portion 12*b* side comes into contact with the mouth portion 110 of the can container 100. For example, in the flat plate portion 12*a*, the sealed portion is configured to be thicker than other portions.

The sliding layer 41 is made of a resin material having a hardness that is relatively higher (i.e., harder) than that of the sealing layer 42. Also, the sliding layer 41 is made of a resin material not having bondness or adhesiveness with the resin film layer of the cap body 11. That is, the sliding layer 41 is not bonded to the top plate portion 21, and slides on the top plate portion 21 state of being in contact with the top plate portion 21.

Examples of the resin material used for the sliding layer 41 include olefin resins such as polypropylene resin and polyethylene resin, polyester resins such as polyethylene terephthalate, styrene resins, and acrylic resins. In the present embodiment, the sliding layer 41 is made of, for example, polypropylene resin. Pigments, lubricants, softeners and the like can be appropriately added to the resin material used for the sliding layer 41.

The sliding layer 41 is provided separately from the cap body 11 so as to face the top plate portion 21 of the cap body 11. The sliding layer 41 is configured to be slidable with the top plate portion 21 of the cap body 11 depending on the resin material used. The sliding layer 41 is formed in a disk shape. The outer diameter of the sliding layer 41 is smaller than the inner diameter of the skirt portion 22, is larger than the inscribed circle of the plurality of knurl portions 31, is the same diameter as the inscribed circle passing through partly in the axial direction of the inclined surfaces 32*a* of the plurality of recessed portions 32, and is larger than the outer diameter of the curl portion 113 of the mouth portion 110.

The sliding layer 41 includes a first flat plate portion 41*a* having a uniform thickness, a first curved surface portion 41*b* whose outer surface of the outer peripheral edge on the top plate portion 21 side is formed of a curved surface, and a protrusion 41*c* provided on the sealing layer 42 side of the first curved surface portion 41*b*. The thickness of the portion of the first flat plate portion 41*a* from the center of the sliding layer 41 to the outer peripheral side of the portion opposed to the curl portion 113 of the mouth portion 110 is uniform.

The first curved surface portion 41*b* is configured so that the thickness of the portion thereof from the outer peripheral side of the portion opposed to the curl portion 113 of the mouth portion 110 to the outer peripheral edge gradually decreases toward the outer peripheral edge. The protrusion 41*c* is formed in an annular protrusion shape that is inclined with respect to the axial direction of the sliding layer 41 and the surface direction of the top plate portion 21 and is curved or inclined toward the opening end side of the skirt portion 22. The thickness of the protrusion 41*c* gradually decreases from the first curved surface portion 41*b* toward the tip.

The sealing layer 42 is made of a resin material having a hardness relatively lower (i.e., softer) than that of the sliding layer 41. Examples of the resin material used for the sealing layer 42 include olefin resins, polyester resins, styrene resins, and acrylic resins, more preferably, blend materials of a styrene elastomer and a polypropylene resin, blend materials of low-density polyethylene and a styrene elastomer, and polyester elastomers. In the present embodiment, the sealing layer 42 is made of, for example, a mixed material of a styrene elastomer and a polypropylene resin. Pigments, lubricants, softeners, and the like can be appropriately added to the resin material used for the sealing layer 42.

The sealing layer 42 is integrally provided on the main surface of the sliding layer 41 on the side opposed to the mouth portion 110. The sealing layer 42 is formed in a disk shape. The outer diameter of the sealing layer 42 is larger than the outer diameter of the curl portion 113 of the mouth portion 110, and is substantially the same as the cuter diameter of the sliding layer 41.

The sealing layer 42 includes: a second flat plate portion 42*a* configured so that the thickness of a portion opposed to the mouth portion 110 is larger than the other portions; a second curved surface portion 42*b* configured so that an outer surface of the outer peripheral edge on the top plate portion 21 side is formed of a curved surface; and an annular depression 42*c* provided on the main surface of the second curved surface portion 42*b* opposite to the sliding layer 41 side. The main surface of the second flat plate portion 42*a* opposed to the curl portion 113 is formed to be flat. For example, the second flat plate portion 42*a* is configured to have the same diameter as that of the first flat plate portion 41*a* of the sliding layer 41. The second flat plate portion 42*a*, together with the first flat plate portion 41*a*, constitutes the flat plate portion 12*a* of the sealing member 12.

The second curved surface portion 42*b* includes, for example, a main surface that is flush with the main surface of the second flat plate portion 42*a* opposed to the curl portion 113. The second curved surface portion 42*b* is configured such that the thickness of the portion from the outer peripheral side of the portion opposed to the curl portion 113 of the mouth portion 110 to the outer peripheral edge is gradually decreased toward the outer peripheral edge. The second curved surface portion 42*b* is stacked on the first curved surface portion 41*b* and the protrusion 41*c*. The second curved surface portion 42*b*, together with the first curved surface portion 41*b* and the protrusion 41*c*, constitutes the curved surface portion 12*b* of the sealing member 12.

The annular depression 42*c* has, for example, a semicircular cross section. When the sealing member 12 is centered on the cap body 11, the depression 42*c* comes into contact with, for example, the end of the knurl portion 31 on the vent slit 31*a* side.

Such a sealing member 12 is locked by the knurl portion 31 by coming into contact with the end of the knurl portion 31 on the vent slit 31*a* side when the cap 1 is arranged with the top plate portion 21 facing upward and the sealing member 12 falls below the top plate portion 21. Therefore, the sealing member 12 is regulated from moving downward in the direction of gravity. Further, when the cap 1 is removed from the can container 100, the sealing member 12 is supported by the knurl portion 31, and thereby is separated from the mouth portion 110 and moved together with the cap body 11.

A method of manufacturing the cap 1 configured as described above will be briefly described below. Firstly, the cap body 11 on the cup is, for example, form a metal plate material. Next, the cap body 11 is arranged on a lower mold with the top plate portion 21 positioned on the lower side in the direction of gravity. Next, a melted or softened resin. material for the sliding layer 41 is supplied onto the top plate portion 21, and a resin material supplied by an upper mold is compression-molded to form the sliding layer 41. Next, a melted or softened resin material for the sealing layer 42 is supplied onto the sliding layer 41, a resin material supplied by an upper mold is compression-molded to form the sealing layer 42 on the sliding layer 41. Thereafter, the knurl portion 31, the recessed portion 32, the vent slit 31*a*, the tamper evidence band portion 34, and the like are formed on the skirt portion 22 of the cap body 11. The cap 1 is manufactured by such a process.

The manufactured cap 1 has a posture in which the top plate portion 21 of the cap 1 is positioned upward when the cap 1 is attached to the mouth portion 110 of the can container 100. At this time, the sealing member 12 descends while being in contact with the inclined surface 32*a* of the recessed portion 32 on the top plate portion 21 side, so that the sealing member 12 is positioned in the center of the cap body 11. When the sealing member 12 descends by a certain distance, supported the end of the knurl portion 31, so that the movement of the sealing member 12 in the descending direction is regulated. When the cap 1 covers the mouth portion 110 in this state, a predetermined portion of the sealing layer 42 of the sealing member 12 faces the mouth portion 110. In this state, the skirt portion 22 is subjected to roll-on molding while the corner portion 23 of the cap body 11 is drawn, so that the cap 1 is fastened and fixed to the mouth portion 110 of the can container 100.

According to the cap 1 configured as described above, the skirt portion 22 is provided with a plurality of, preferably three or more, recessed portions 32 for regulating the movement of the sealing member 12 in the radial direction of the cap 1. Thus, it is possible to position the sealing member 12 in the radial direction in the cap body 11 by bringing the sealing member 12 into contact with the inclined surface 32*a* of the recessed portion 32. That is, the plurality of recessed portions 32 suppress the displacement of the sealing member 12 in the radial direction in the cap body 11, so that the position of the sealing member 12 with respect to the cap body 11 in the radial direction can be fixed. As a result, when the mouth portion 110 of the can container 100 is covered with the cap 1, the sealing member 12 can be reliably brought into close contact with the mouth portion 110 at a predetermined position. Therefore, the cap 1 can improve the sealability with the mouth portion 110 of the can container 100, and can also improve the drawability, tamper evidence, fall resistance, and fastening the corner portion 23 of the cap body 11. That is, when the cap 1 is fastened onto the can container 100, high sealability can be ensured even when the sealing member 12 not bonded to the cap body 11 is used. Even when the can container 100 is resealed, the cap can ensure high sealability because the sealing member 12 is centered by the recessed portion 32.

Further, at least a portion of the recessed portion 32 (which is a regulating portion for positioning the sealing member 12 in the radial direction) that comes into contact with the sealing member 12 is arranged closer to the top plate portion 21 than the knurl portion 31 (which is a locking portion for regulating the movement of the ling member 12 in the axial direction and in the direction away from the top plate portion 21). With this configuration, when the cap 1 has a posture in which the top plate portion 21 is positioned upward, the sealing member 12 is supported by the end of the knurl portion 31 after the sealing member 12 is reliably brought into contact with the recessed portion 32, therefore allowing the sealing member 12 to be reliably positioned in the radial direction.

The inclined surface 32*a* of the recessed portion 32 is configured to be inclined toward the inner side of the cap body 11 so as to face the top plate portion 21 as it moves away from the top plate portion 21. Therefore, when the cap 1 has a posture in which the top plate portion 21 positioned upward, the sealing member 12 moves toward the knurl portion 31 while being in contact with the plurality of inclined surfaces 32*a*, so that the sealing member 12 can be positioned reliably. The diameter of a tangent circle that is continuous with the radially innermost ends of the ends of the plurality of knurl portions 31 on the vent slit 31*a* side is set to be smaller than the diameter of a tangent circle that is continuous with the lowermost ends of the plurality of inclined surfaces 32*a* in the axial direction. Therefore, the end of the knurl portion 31 as a locking portion that is on the vent slit 31*a* side can reliably regulate the movement of the sealing member 12 in the direction away from the top plate portion 21.

Further, the sealing member 12 has a configuration in which the outer peripheral edge is formed to be thinner than the other parts and the outer peripheral edge is more easily deformed than the other parts, so that is possible to prevent, to the extent possible, the phenomenon in which when the sealing member 12 comes contact with the inclined surface 32*a* of the recessed portion 32, the contacted edge deforms and the sealing member 12 is supported in the recessed portion 32. As a result, the cap 1 can support the sealing member 12 at the end of the knurl portion 31 as a locking portion that is on the top plate portion 21 side.

Since the recessed portion 32 for positioning the sealing member 12 with respect to the cap body 11 is configured to alter a part of the knurl portions 31 conventionally provided, an apparatus for manufacturing the cap 1 may form the recessed portion 32 with a part of a mold for forming the portion 31. Therefore, the apparatus for manufacturing the cap 1 including the recessed portion 32 only needs to change the mold with no need to significantly change the equipment from the conventional equipment, making it possible to prevent an increase in the equipment cost.

As described above, according to the cap 1 of the embodiment of the present invention, the sealing performance of the sealing member 12 not bonded to the cap body 11 can be secured when the mouth portion 110 of the can container 100 is covered with the cap 1.

The present invention is not limited to the embodiment described above. For example, in the above-described example, the configuration in which the knurl portions 31 are provided at thirteen areas of the skirt portion 22 and the recessed portions 32 are provided at four areas of the skirt portion 22 is described; however, the present invention is not limited thereto. That is, the knurl portion 31 can be suitably set as long as a function of being able to discharge gas or the like in the can container 100 when the can container 100 is opened is achieved by the vent slit 31*a*, and the number and shape of the knurl portions 31 are those that allow the sealing member 12 to be securely locked. Also, the number and shape of the recessed portions 32 can be suitably set as long as they can regulate the radial movement of the sealing member 12 and perform centering of the sealing member 12 so that the center of the sealing member 12 is arranged concentrically with the center of the cap body 11. However, the recessed portions 32 are preferably configured so that they are arranged at three or more areas at least in the circumferential direction with predetermined intervals and that they include an inclined surface 32*a* facing the top plate portion 21. Also, the distance in the axial direction from the top plate portion 21 to the knurl portion 31 and the recessed portion 32 can be suitably set; however, the distance is preferably such that the moving sealing member 12 does not fall out from the plurality of knurl portions 31 and the plurality of recessed portions 32.

Further, in the above-described example, the configuration in which an end of the knurl portion 31 on the top plate portion 21 side is set as the locking portion for supporting the sealing member 12 and preventing the sealing member 12 from falling off from the cap body 11 by providing the vent slit 31*a* on the top plate portion 21 side, is described. However, the present invention is not limited thereto. For example, the locking portion may be configured so that a protrusion other than the knurl portion 31 and the recessed portion 32 is provided on the skirt portion 22. For example, the vent slit 31*a* may be provided on the side opposite to the top plate portion 21 side in the axial direction, so that the locking portion is formed by a surface of the knurl portion 31 protruding from the inner peripheral surface of the skirt portion 22.

Even if the recessed portion 32 is provided while setting the end of the knurl portion 31 on the top-plate portion 21 side 20 provided with the vent slit 31*a* as the locking portion, it suffices that a molding apparatus uses a mold to form the knurl portion 31 and the recessed portion 32. Therefore, the configuration in which the end of the knurl portion 31 on the top plate portion 21 side provided with the vent slit 31*a* is set as the locking portion is preferable because the manufacturing cost can be reduced and the manufacturing becomes easy. In manufacturing the cap 1, there is a case where, for example, after the sealing member 12 is molded by a cap body 11, the molded sealing member 12 is supplied to another cap body 11. In this case, with the vent slit 31*a* provided on the top plate portion 21 side of the knurl portion 31, the inner surface of the knurl portion 31 is continuous with the inner surface of the skirt portion 22 in the direction of inserting the sealing member 12 into the cap body 11, therefore achieving the effect of being able to easily insert the sealing member 12.

The present invention is not limited to the above-described embodiments and can be modified in various manners in practice when implementing the invention without departing from the gist of the invention. The respective embodiments may be appropriately combined, in which case a combined effect will be achieved. Furthermore, the above-described embodiments include various inventions, and various inventions can be derived by combinations of constituent elements selected from the plurality of disclosed constituent elements. For example, even if some of the elements disclosed in an embodiment are deleted, a configuration excluding the elements can be derived as an invention as long as the problem can be solved and the effect can be achieved.

The invention claimed is:

1. A cap comprising:

a cap body comprising a disk-shaped top plate portion and a skirt portion provided on a peripheral edge of the top plate portion;

a sealing member that is a separate member from the cap body and is provided in the cap body so as to face the top plate portion, the sealing member having an outer diameter smaller than an inner diameter of the skirt portion;

a plurality of locking portions provided in a circumferential direction of the skirt portion, and configured to regulate a movement of the sealing member, in an axial direction of the skirt portion, away from the top plate portion and support the sealing member; and a plurality of regulating portions provided in the circumferential direction of the skirt portion, protruding inward in a radial direction from an inner peripheral surface of the skirt portion, and configured to regulate a radial movement of the sealing member, wherein each regulating portion amongst the plurality of regulating portions is arranged in the circumferential direction between corresponding locking portions, and said each regulating portion amongst the plurality of regulating portions is positioned closer to the top plate portion than each of the plurality of locking portions that regulates the movement of the sealing member, wherein the plurality of regulating portions, which are provided in the circumferential direction of the skirt portion, comprise respective inclined surfaces configured so that an inner surface of the skirt portion is inclined in a direction away from the top plate portion in said axial direction and inclined inward in the radial direction, and wherein a diameter of a tangent circle that is continuous with innermost ends of the plurality of locking portions is set to be smaller than a diameter of a tangent circle that is continuous with lowermost ends of the plurality of inclined surfaces of the plurality of regulating portions.

2. The cap according to claim 1, wherein the sealing member is configured so that an outer peripheral edge is thinner than a sealing portion that comes into contact with a mouth portion of a container.

3. The cap according to claim 1, wherein at least a part of each of the plurality of locking portions protrudes in a radial direction inward from the inner peripheral surface of the skirt portion.

4. The cap according to claim 1, wherein the diameter of the tangent circle that is continuous with the lowermost ends of the plurality of inclined surfaces of the plurality of regulating portions is the same as an outer diameter of the sealing member at least in part in the axial direction.

* * * * *